United States Patent [19]

Frantz

[11] 4,395,135

[45] Jul. 26, 1983

[54] OPTIONAL ALARM AND BATTERY BACKUP SYSTEM FOR A TALKING TIMEPIECE

[75] Inventor: Richard J. Frantz, Cheshire, Conn.

[73] Assignee: Timex Corporation, Waterbury, Conn.

[21] Appl. No.: 375,412

[22] Filed: May 6, 1982

[51] Int. Cl.[3] ..... G04B 21/08

[52] U.S. Cl. ..... 368/63; 368/64; 368/66; 368/48; 368/82

[58] Field of Search ..... 368/63, 64, 66, 12, 368/48, 46, 82, 87, 274, 203, 204, 52, 53, 59; 179/1 SM, 1 SA

[56] References Cited

U.S. PATENT DOCUMENTS

| | | | |
|---|---|---|---|
| 3,889,461 | 6/1975 | Marti et al. | 368/52 |
| 3,918,250 | 11/1975 | Torresdal | 368/64 |
| 3,938,317 | 2/1976 | Spano | 368/63 X |
| 3,998,045 | 12/1976 | Lester | 368/63 |
| 4,040,247 | 8/1977 | Haydon | 368/204 X |
| 4,334,298 | 6/1982 | Asada | 368/63 |

*Primary Examiner*—Ulysses Weldon

*Attorney, Agent, or Firm*—William C. Crutcher; Joseph A. Biela

[57] ABSTRACT

A talking timepiece which has two operating modes is disclosed. In a first mode, a power supply provides power to a computer and speech processing circuitry and the computer responds to the switching of a keyboard voice/tone switch for controlling either the speech processing circuitry to produce voice messages at predetermined times or tone alarm generator circuitry to produce tone sounds at predetermined times. In a second or power supply failure mode, a battery backup, which is connected in parallel to the power supply, provides power to only the computer and not the speech processing circuitry when the power supply fails. During this second mode, a switching circuit bypasses the keyboard voice/tone switch and the computer automatically controls only the tone alarm generator circuit. The tone alarm generator circuit is independent of the speech processing circuitry.

3 Claims, 1 Drawing Figure

OPTIONAL ALARM AND BATTERY BACKUP SYSTEM FOR A TALKING TIMEPIECE

BACKGROUND OF THE INVENTION

It is known in the art to synthesize speech using, generally, a speech synthesis processor and voice synthesis ROM. U.S. Pat. No. 3,998,045 issued to Lester discloses a timepiece that can be worn as part of a hearing aide or as a wristwatch that audibly announces time on demand using synthesized speech messages. In U.S. Pat. No. 4,279,030 issued to Masuzawa et al. discloses a speech-synthesizer timepiece that first produces an audible warning signal indicating that an audible speech message announcing time will follow and then produces the audible speech message representative of the updated time information. The advanced warning signal is provided to indicate that a voice message announcing updated time will follow. A time interval counter initiates the audible warning sound and a time delay provides for a pause between the warning sound and the voice message.

A voice annunciating system is disclosed in U.S. Pat. No. 3,641,496 issued to Slavin that has sensors that provide signals to control circuitry in response to specific detected conditions for selecting the proper synthesized speech message to be transmitted by the voice system identifying those conditions. The sensors detect conditions other than time although the control logic circuitry selects the appropriate speech message in response to the specific condition detected by the sensors.

Additional pertinent patents that show speech processing in response to either direct operator input to the speech processing circuitry or in response to updated time information provided by the timekeeping circuitry include U.S. Pat. No. 4,304,965 issued to Blanton et al., U.S. Pat. No. 4,287,584 Tanimoto et al. U.S. Pat. No. 4,060,848 issued to Hyatt, U.S. Pat. No. 4,016,540 issued to Hyatt, and U.S. Pat. No. 3,870,818 issued to Barton et al., However, as far as can be determined, no prior art timepiece has a battery backup to power a control computer when the main power supply, which provides power to the control computer and speech processing circuitry, fails. Furthermore, no existing timepiece produces a tone alarm when the speech processing circuitry is disabled during a main power supply failure and the timepiece being powered by a back-up battery.

An object of the invention is to continue to provide power to the talking timepiece circuitry during a power supply failure so that a functional tone alarm will be automatically provided by a computer controlled tone alarm generator even though the computer controlled speech processing circuitry is disabled.

Another object of this invention is to provide a timepiece having an optional and manually selectible means for announcing time by either speech synthesized messages or tone alarm sounds.

Another object of the invention is to bypass the manually selectible means during a power supply failure.

An additional object of the invention is to prevent incomplete speech messages when a subsequent speech message is requested.

A further object of the invention is to reduce the power dissipation in the main power supply.

SUMMARY

A talking timepiece is disclosed having at least two modes of operation. A first or normal mode in which at least one keyboard voice/tone switch may be manually switched to provide for either computer controlled speech processing circuitry that produces audible speech sounds in the form of voice messages for announcing time or computer controlled tone alarm generator circuitry that produces tone sounds for signaling (announcing) time. A second mode of operation, the power supply failure mode, occurs when the timepiece power supply, which, during the first mode of operation, provides power to the control computer and the speech processing circuitry, fails and a battery backup continues to provide power to the control computer but not to the speech processing circuitry.

During the normal mode of operation of the timepiece, the computer responds to the switching of at least one voice/tone switch and thereby controls either the speech processing circuitry or the tone alarm generator circuitry. When the timepiece power supply fails, voice/tone switching is bypassed by a switching circuit and the control computer provides for automatic control of the tone alarm generator circuitry independent of the voice/tone switch.

DESCRIPTION OF THE PREFERRED EMBODIMENT

Figure 1:
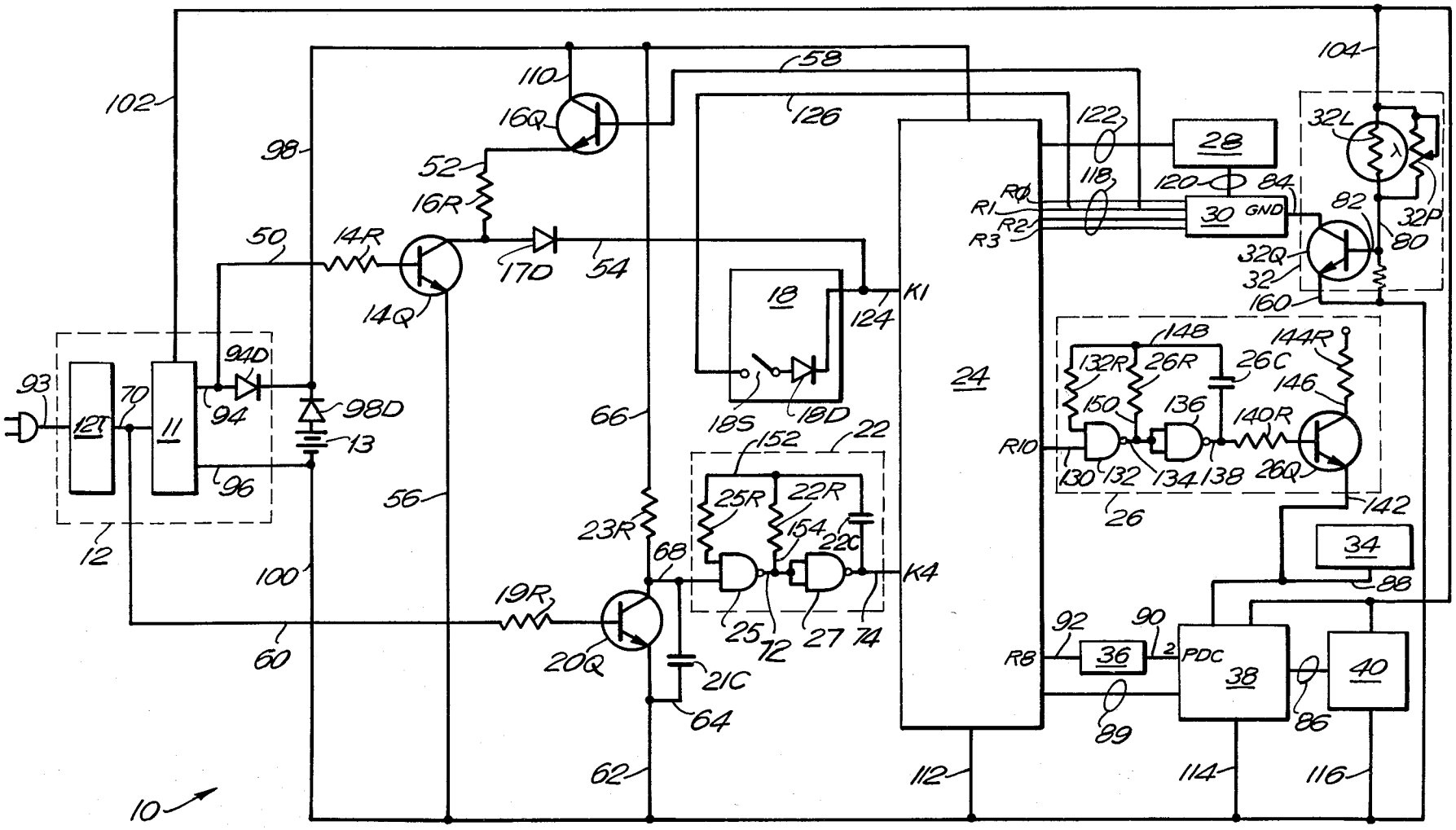
FIG. 1 is a block diagram of the talking timepiece circuit emphasizing discrete circuit components according to the preferred embodiment of the present invention.

Referring to FIG. 1, talking timepiece circuit 10 is shown which includes power supply 12, backup battery 13, oscillator 22, keyboard 18, control computer 24, tone alarm generator 26, display 28, display/driver 30, automatic dim sensor 32, audio amplifier and speaker 34, speech processor 38, vocabulary ROM 40, latch 36 and additional semiconductor devices. The part numbers for some of the various commercially available components are provided in the table below:

| Component | Identifying Number |
|---|---|
| Control Computer | TMS 1000 |
| Speech Processor | TMS 5100 |
| Vocabulary ROM | TMS 6125 |

Generally, talking timepiece circuit 10 is able to operate in two modes. The first mode or normal operating mode occurs when power supply 12 is used to provide power to automatic dim sensor 32, speech processor 38 and vocabulary ROM 40 as well as to control computer 24. The speech processor and vocabulary ROM form the speech processing circuitry. Power supply 12 receives standard 110 volt AC power along line 93 unless an AC power failure occurs. When an AC power failure occurs, power supply 12 is no longer operable and backup battery 13 is used to provide power to the circuit and, in particular, to the control computer. The second mode or battery backup mode occurs when power fails along line 93 in which case speech processor 38 and vocabulary ROM 40 become inoperable. Battery 13 provides power to the control computer 24 when circuit 10 is in the battery backup mode. However, when an AC power failure occurs, battery 13 is not required to provide power to the speech processor and vocabulary ROM thereby extending the battery's life over a longer period of time. This second mode is also the power supply failure mode.

The timepiece can announce predetermined periods of time by either sounds of a tone alarm provided by tone alarm generator 26 or at least one voice message provided by the speech processing circuitry. The tone alarm generator and speech processing circuitry are both under the control of control computer 24. However, tone alarm sounds are provided by an independent integrated circuit tone alarm generator 26 whereas a voice message is provided by speech processor 38 and vocabulary ROM 40. The tone alarm generator is independent of speech processing circuitry. Either the tone alarm or the speech message may be selected by control computer 24, in response to the position of switch 18S in keyboard 18, to announce time only when the timepiece is in the normal operating mode. When the timepiece is in the battery backup or power failure mode, only the alarm signals of the tone alarm are provided for announcing time. The tone alarm is optional only when the timepiece is in the normal operating mode and the timepiece is in the normal operating mode when the control computer, the speech processor and the vocabulary ROM are being powered by power supply 12. When an AC power failure occurs and the timepiece is placed in the battery backup mode, battery 13 provides power to the control computer but not to the speech processing circuitry. As a result, time announcements can only be made by a tone alarm produced by the tone alarm generator during the battery backup or power supply failure mode.

Referring to FIG. 1, power supply 12 provides power to speech processor 38, vocabulary ROM 40 and automatic dim sensor 32 during the normal operating mode by way of line 102. The power supply also provides power to control computer 24 along line 98. (During the battery backup mode, battery 13 provides power to the control computer along line 98 but not to the speech processing circuitry.) When the timepiece is in the normal operating mode, a computer program in control computer 24 operates on data provided to it on input line 124 and selects, based on the input data, whether a tone alarm is to be generated or whether a speech (voice) message is to be generated. If a tone alarm is selected, computer 24 provides a triggering signal on output line 130 to first NAND gate 132 in tone alarm generator 26. Tone alarm generator 26 produces an output signal on line 88 that is transmitted to audio amplifier and speaker 34 for producing the tone alarm sound announcing the time. If a speech message is selected, the computer program in control computer 24 provides control signals along multiple lines 89 to speech processor 38. Speech processor 38, in response to the control signals, assembles the words stored in vocabulary ROM 40 to form the appropriate message which is provided along line 88 to audio amplifier and speaker 34 for producing a speech message announcing the time.

Time announcement by either tone alarm sounds or a speech message is provided as a result of the execution of the computer program in control computer 24. The program receives data during its execution, at computer input pin K1, from input line 124 for selecting how time will be announced. During the normal operating mode, time announcement is first preselected by setting the appropriate switch on keyboard 18 for providing a signal along line 124 representing how time is to be announced. However, during the battery backup mode (power supply failure mode), the appropriate time announcement selection switch is bypassed since announcing time by either a tone alarm or a speech message is no longer optional. Time announcement can only be made, during battery backup, by tone alarm sounds produced by tone alarm generator 26 which is controlled by computer 24. As will be discussed below, a switching circuit portion of timepiece circuit 10, to include lines 58 and 54 and first and second transistors, 14Q and 16Q respectively, are provided to automatically put the timepiece in the tone alarm condition when AC power fails and the timepiece is in the battery backup mode.

The correct time is provided on display 28. The light intensity of each character of the display is variable such that as ambient light intensity becomes greater, the light emanating from the display characters increases. As the ambient light intensity decreases the light intensity emitted by the display characters decreases. The light intensity of the display varies in direct proportion to the light intensity of the ambient light. The light intensity of the display is automatically controlled by automatic dim sensor 32 and will be explained later.

Power supply 12 provides a voltage across resistor 14R in line 50 causing a base current to flow into the base of first common emitter transistor 14Q turning it on. The base current along line 50 removes the collector-base reverse bias and increases the current into the collector of transistor 14Q. Current is produced along line 56 to ground 100 from the emitter of transistor 14Q. Common emitter transistor 14Q prevents second common collector trasistor 16Q from conducting amplified current along line 54 to the K1 input pin of control computer 24 via line 124. This will be discussed more fully later in terms of bypassing voice/tone time announcement selection switch 18S on keyboard 18 during an AC power failure.

Power supply unit 12 includes transformer 12T and rectification unit 11 wherein the transformer is connected to the rectification unit by line 70. The 60 Hz voltage signal provided by transformer 12T on line 70 due to the AC signal on line 93 is applied across resistor 19R in line 60 causing a base current to flow periodically into third common emitter transistor 20Q thereby turning it on and off at the 60 Hz rate. The emitter current of transistor 20Q is provided to ground on line 62. When transistor 20Q is on, a collector current is provided along line 66 through resistor 23R and, thereafter, along line 68 to oscillator 22 for the purpose of synchronizing the oscillator output with the 60 Hz signal provided at the output of transformer 12T. Capacitor 21C is provided in line 64, which is connected between line 68 and line 62, for bypassing unwanted noise and electrical artifacts to ground.

Regulated power supply 12 receives 110 volts AC power along line 93. Transformer 12T in power supply 12 steps down the voltage received from line 93. The stepped-down voltage is provided to power supply rectification unit 11 along line 70. Rectification unit 11 produces a rectified partially smoothed pulsating direct current signal having peak voltage between line 94 and ground line 96. Power supply 12 is connected in parallel across backup battery 13 which, in this embodiment, is 9 volts. Specifically, line 94, extending from power supply 12 connects line 98 extending from the positive side of battery 13 and ground line 96, also extending from power supply 12, connects ground line 100 extending from the negative side of battery 13. Diode 94D in line 94 prevents current drawn from battery 13 on line 98 from flowing to power supply 12 on line 94. Similarly, diode 98D prevents current drawn from power supply 12 on line 94 from flowing to the positive side of battery 13.

The collector side of transistor 16Q, line 110, and the collector side of transistor 20Q, line 66, are connected to line 98 which is, in this embodiment, at a potential of zero volts. The power supply ground which, in this embodiment, is at a potential of −9 volts, is provided along line 100. The emitter side of transistor 14Q, line 56, the emitter side of transistor 20Q, line 62, and the emitter side of transistor 32Q, are all connected to power supply ground 100. Also, the control processor, speech processor and volcabulary ROM are connected to ground line 100 via lines 112, 114 and 116, respectively.

Oscillator 22, which clocks control computer 24 when the timepiece is in the battery backup mode during an AC power failure, receives a triggering signal along line 68 to the first input port of first NAND gate 25. The output signal from gate 25 is provided to both input ports of second NAND gate 27 which produces at least one output pulse on line 74 having a time period which represents the period of oscillation of oscillator 22 as a function of resistor 22R, capacitor 22C, the transfer voltage threshold at which oscillator 22 switches from one logic level to the other and the oscillator supply voltage. The time period is the combined time periods for when the output of the oscillator is high and for when the oscillator output is low. The output signal pulse widths on line 74 are primarily a function of resistor 22R and capacitor 22C as long as the threshold voltage is approximately one-half of the supply voltage even if the trigger input signal on line 68 is wider than the output pulse on line 74. Resistor 25R is provided to minimize the sensitivity of the oscillator to supply voltage changes and has substantially no effect on the oscillator output frequency which is inversely proportional to the time period. Capacitor 22C and resistor 25R are in feedback line 152 which is connected between line 74 and the second input port of first NAND gate 25. Resistor 22R is in line 154 which is connected between line 152 and line 72. The oscillator output signal is provided along line 74 to input pin K4 of control computer 24.

Display 28 provides, in digital form, a correct representation of the present time. Display 28 is driven by display driver 30 which is provided digital signals from control computer 24 along multiple lines (R-lines) 118. Specifically, R-lines 118 connect control computer 24, at output pins R0 through R3, with driver 30. The display driver provides output signals to display 28 along multiple lines (Y-lines) 120 in predetermined relationship with the parallel output data signals transmitted from control processor 24 along multiple output data lines (O-lines) 122. Specifically, output data is transferred to O-lines 122 while substantially simultaneously a low signal is provided from output pin R3 to enable driver 30 to provide a low signal on the appropriate Y-line in multiple lines 120. The data on the O-lines and the low signal on the appropriate Y-line are transmitted to display 28. The digit representation in display 28 turns on and the corresponding keyboard scan line 126 (to be explained later) has a high signal. A high signal provided from pin R3 disables driver 30 and information on the O-lines are updated. In other words, the output signals provided on the O-lines drive the display segments and digits while the output signals provided on the R-lines control the scan of the digits of the display as well as the keyboard selection switches.

Keyboard 18 is connected to the K1 input pin of control computer 24 by line 124. R-lines 118 which are used to control the scan of display 28 are also used for scanning each selection switch implemented in keyboard 18 (not all are shown) during the normal timepiece operating mode. The R-lines are strobed upon execution of the computer program in computer 24 to scan the selection switches of keyboard 18. One switch input which is shown, voice/tone switch 18S, provides for a tone signal at predetermined times when switch 18S is in the closed position and provides for a speech message at predetermined times when switch 18S is opened. Diode 18D, between switch 18S and computer input pin K1, provides for current flow in only one direction, i.e., through switch 18S, when closed, to control computer input pin K1. The selection of the tone sounds or speech message can only be accomplished when the timepiece is in the normal operating mode. Generally, each one of the R-lines is sequentially set for a given period of time, then reset. For the time that an R-line is set high, a voltage, representing a logic level one, is provided to a predetermined switch in keyboard 18. In this embodiment, the line in R-lines 118 that emanates from output pin R1 provides periodic (set) pulses to switch 18S along line 126. Therefore, when switch 18S is closed, a logic level one, corresponding to a set pulse, is transmitted to line 124 as input to control computer 24 at input pin K1. When switch 18S is not closed, a zero logic level is provided as input to computer 24 at input pin K1. Either logic level one or logic level zero (data), provided to pin K1 of computer 24, is detected by the computer program and interpreted as a function to be performed in response to the data entry. More than one switch in keyboard 18 will provide a logic level one or zero simultaneously to computer 24 on line 124 depending upon whether each switch is opened or closed. In effect, the timepiece circuit is performing a test or scan to determine which switches are opened or closed so that the circuit will perform the selected function in response to the opened and closed switches in the keyboard. For example, if four switches in keyboard 18 are tested and only the first of the four switches is closed, then a binary code (0001) is presented to input pin K1 of control computer 24. The computer program in the control computer subsequently decodes the binary code (0001) and performs the function indicated by the coded data entry.

During the battery backup mode when an AC power failure occurs, backup battery 13 provides power to control computer 24 but not to speech processor 38 or vocabulary ROM 40. Therefore, during a power failure, the timepiece can only announce time by tone sounds provided by tone alarm generator 26. At least a functional alarm is provided during the battery backup mode even though no speech message announcing time can be produced. Nevertheless, the scanning of switch 18S in keyboard 18 by the R-line emanating from pin R1 would continue along line 126 unless selection switch 18S was bypassed. A selection switch scan bypass is provided in timepiece circuit 10. The switch scanning bypass occurs automatically when an AC power failure occurs since first common emitter transistor 14Q stops conducting and turns off. It will be recalled that transistor 14Q is turned on due to the base current that is drawn by resistor 14R in line 50 from power supply 12. During a power failure, a base current no longer flows into the base of transistor 14Q through line 50 such that the first transistor turns off. On the other hand, each time the R-line emanating from pin R1 of computer 24 is set at a high logic level, second common collector transistor 16Q is turned on due to the base current that flows into the base of transistor 16Q along line 58. A base current for the second transistor is produced along line 58 each time a high level logic signal is provided at output pin R1 by computer 24. Common collector transistor 16Q, during the time that it is on, produces an amplified emitter current along line 52 through resistor 16R and along line 54 through diode 17D directly to input line 124 leading to the K1 input pin of control chamber 24. Transistor 14Q can no longer prevent the emitter current produced by transistor 16Q from flowing along line 54 to the computer since transistor 14Q has been turned off. Transistor 16Q provides an amplified current signal along line 54 that bypasses keyboard 18 but that is transmitted directly to control computer 24 through input pin K1 just as though switch 18S was closed in keyboard 18. This is substantially equivalent to a continuously closed selection switch 18S when the timepiece is in the normal operating mode. The executing computer program in control computer 24 responds to and interprets each amplified current signal provided by transistor 16Q as an indication that a tone alarm is to announce updated time. This selection switch scan bypass of keyboard 18, automatically implemented during the battery backup mode (power supply failure mode), produces a result equivalent to selecting the optional tone alarm during the normal operating mode when switch 18S is continuously closed. The high level logic signals produced at pin R1 are received by the computer via line 58, transistor 16Q and lines 52 and 54 at pin K1 regardless of the position of switch 18S and are interpreted by the program in the computer as though switch 18S was closed. Only tone alarm sounds can be produced to announce time when the selection switch scan bypass is implemented.

In summary, during the battery backup mode, switch 18S becomes inoperable and is bypassed. Scanning continues, though, along line 58 through transistor 16Q and along line 54 directly to input pin K1 of computer 24. The high level logic signal provided directly to control computer 24 is decoded by the computer program to mean that subsequent time announcements will only be provided by the tone alarm generator 26 in the form of a tone alarm. During a power failure, the timepiece unconditionally and automatically provides for tone alarm sounds during the battery backup mode. Thus, a functional alarm is provided during an AC power failure even though the speech processing circuitry is disabled.

During the normal operating mode when switch 18S is closed and during the battery backup mode when switch 18S is entirely bypassed, a tone alarm is provided. The tone alarm is optional during the normal operating mode of the timepiece but is the only means by which time is announced during the battery backup mode when an AC power failure occurs. The tone alarm is under the control of the control computer 24 as is the speech processing circuitry. However, the tone alarm is generated by a separate tone alarm generator 26 and not by the speech processing circuitry. When a high level logic signal is provided on line 124 to computer input pin K1, the computer program encodes the signal. If the logic level signal was provided along line 58 or along line 126 through switch 18S when the tone alarm sounds are to be provided by tone alarm generator 26 for announcing time. To trigger the tone alarm generator, the control computer, at predetermined times, produces a signal on line 130 from output pin R10 to the first input port of first NAND gate 132 in the tone alarm generator. The description of the tone alarm generator is substantially identical to the description of oscillator 22. In this case, gate 132 responds to the trailing edge of the positive going signal on line 130 (or the leading edge of a negative going signal on line 130) and produces a signal on line 134. The signal on line 134 is received by both input ports of second NAND gate 136 which produces output pulses on line 138 each having a time period which represents the period of oscillation of tone alarm generator 26 as a function of resistor 26R, capacitor 26C, the transfer voltage threshold at which tone alarm generator 26 switches from one logic level to the other and the generator supply voltage. Resistor 132R is provided to minimize the sensitivity of the generator to supply voltage changes. The output pulses on line 138 are provided to resistor 140R producing a base current that turns on fifth common collector transistor 26Q for the duration of each generator output pulse. Transistor 26Q, when on, produces an amplified emitter current along line 142 to line 88. This current is transmitted along line 88 to audio amplifier and speaker 34 for producing tone alarm sounds. Connected to the collector of transistor 26Q is current limiting resistor 144R in line 146. Capacitor 26C and resistor 132R are in feedback line 148 which is connected between line 138 and the second input port of NAND gate 132. Resistor 26R is in line 150 which is connected between line 148 and line 134.

The voice synthesis processor or speech processor 38 synthesizes speech by processing a variable-data-rate bit stream of encoded speech data received from the voice synthesis memory or vocabulary read-only-memory (ROM) 40 along multiple lines 86 and by providing the synthesized speech along line 88 to be converted to audible output by audio amplifier and speaker 34. Speech processor 38 provides all control signals necessary for the direct interface with vocabulary ROM 40. Control of speech processor 38 is provided by control computer 24 along multiple lines 89. Messages produced by the speech processing circuitry may be requested during the normal operating mode but not during the battery backup mode. The ROM contains the following words and phrases in the addresses provided:

| Address | Word/Phase | Address | Word/Phase |
|---|---|---|---|
| 0000 | Look-up table | 0705 | Fourteen |
| 0056 | OH | 075D | Fifteen |
| 0099 | One | 07AD | Sixteen |
| 00E1 | Two | 0810 | Seventeen |
| 011A | Three | 087D | Eighteen |
| 015E | Four | 08CE | Nineteen |
| 01A4 | Five | 0940 | Twenty |
| 01EE | Six | 0985 | Thirty |
| 0223 | Seven | 09C6 | Forty |
| 026E | Eight | 0A0D | Fifty |
| 02A1 | Nine | 0A4B | The time is . . . |
| 02DE | Chime (#1) | 0AED | Good morning. |
| 036F | Chime (#2 + #4) | 0B5B | Good evening. |
| 040C | Chime (#3) | 0C4F | This is your . . . |
| 04A9 | Alarm | 0CD5 | . . . Second . . . |
| 04FC | A.M. | 0D22 | . . . Third and last . . . |

-continued

| Address | Word/Phase | Address | Word/Phase |
|---|---|---|---|
| 056A | P.M. | 0DD5 | . . . Call. |
| 05D9 | Ten | 0E1F | Delay |
| 0608 | Eleven | 0E27 | Delay |
| 0653 | Twelve | 0E2F | Timex |
| 069B | Thirteen | 0EB6 | Alarm |

Control computer 24 has to "tell" speech processor 38 where to find the speech message in ROM 40 by transmitting this locating information on multiple lines 89. The signal at the PDC pin of speech processor 38 goes low in order to strobe the locating information from the computer to the speech processor. Since the strobe signal at the PDC pin may be momentary, latch 36, connected to control computer pin R8 by line 92 and to speech processor pin PDC by line 90, sets at least one of its bits to a logic level representing either a one or zero to ensure that the speech processor will be ready to receive the message locating information on lines 89 from control computer 24. Latch 36 is provided for synchronizing the speech processor with the control computer so that the speech synthesizer will be ready to receive information when the control computer provides it on multiple lines 89. The message locating information is provided on multiple lines 89 and then strobed into processor 38 by activating speech processor pin PDC.

Automatic dim sensor 32 provides for the light intensity of the display to be substantially directly proportional to ambient light intensity. As ambient light intensity decreases, the light intensity of the display decreases. Automatic dim sensor 32 is a light sensor that includes light dependent resistor (LDR) 32L which is exposed to light through a transparent or translucent casing. The light sensor of the present invention is a "bulk effect" type having a semiconductor in polycrystalline form. However, the sensor may also be a "junction type" which includes one or more PN junctions in a monocrystalline semiconductor. The electrical parameter that varies with ambient light intensity in dim sensor 32 is the resistance of LDR 32L. When the light sensor is not exposed to light, the majority of electrons are firmly bound to the atoms that form the crystal lattices of the photoconductive material used. In this embodiment, cadmium sulphide (CdS) is used as the polycrystalline semiconductor photoconductive material. When light falls on the crystals, energy is absorbed by the lattice and electrons are dislodged from the lattice, and become available to carry current. The cadium sulphide, doped with activating agents such as copper, silver, gallium, chlorine or iodine, begins to conduct and its resistance decreases (increases) as the light intensity on the semiconductor surface increases (decreases).

Specifically, LDR 32L provides a current along line 80 to the base of fourth common emitter transistor 32Q along line 82 turning it on. The emitter of transistor 32Q is directed to ground 100 along line 160. An increasing base current along line 82 increases the forward bias of the base of transistor 32Q thereby increasing the collector current in line 84 and vice versa. When ambient light intensity decreases, the resistance of LDR 32L becomes so high that very little current flows along line 80 to the base of transistor 32Q along line 82. As a result, very little current flows along line 84 between the GND pin of driver 30 and the collector of transistor 32Q. As transistor 32Q approaches the cutoff point, the light intensity of the digits in display 28 become progressively dimmer. On the other hand, as ambient light intensity increases, the resistance of LDR 32L becomes so low that a high base current flows along line 82 thereby providing for an increase in current flow along line 84. In this case the light intensity of the digits of display 28 become brighter. Potentiometer 32P is provided across LDR 32L to make adjustments in current flow through line 80 to the base of transistor 32Q along line 82 to selectively produce a brighter dislay than what otherwise would be produced when the resistance of the LDR becomes very high at low ambient light intensity. One end of potentiometer 32P is connected to power supply line 102 via the 104.

For supplemental, explanatory information about specific commercially available components of the talking timepiece circuit of the invention, reference should be made to the TMS 1000 Family Design Manual (Microcomputer Series) published in 1982 by Texas Instruments, Incorporated, the TMS 1000 Microcomputer Circuit Design Manual published in June 1977 by Texas Instruments, Incorporated and the TMS 5100 Voice Processor Data Manual published in October 1980 by Texas Instruments Incorporated, all of which are incorporated herein by reference.

I claim:

1. A talking timepiece including a keyboard having a voice/tone switch, a speech processor, and a tone alarm generator, said timepiece having at least two modes of operation including a first mode in which said voice/tone switch is provided for selective manual switching between said speech processor adapted to provide for audible speech sounds in the form of voice messages for announcing time and said tone alarm generator adapted to provide for tone sounds for announcing time and including a power supply failure mode in which said voice/tone switch is bypassed, said speech processor is disabled and tone sounds are automatically produced by said tone alarm generator for announcing time, said timepiece comprising:

a. a computer electrically coupled to said keyboard, to said tone alarm generator and to said speech processor and responsive to said selective manual switching of said voice/tone switch for controlling both said speech processor to produce said voice messages at selected times and said tone alarm generator to produce said tone alarm sounds at selected times during said first mode of timepiece operation; and, said computer adapted for automatically controlling said tone alarm generator to produce said tone sounds, independent of said selective manual switching of said voice/tone switch, at predetermined times during said power supply failure mode of timepiece operation, b. a power supply for providing power to said computer and said speech processor during said first mode of timepiece operation, c. a battery backup electrically coupled to said power supply for providing power to substantially only said computer during said power supply failure mode of timepiece operation when said power supply fails, and d. circuit switching means electrically coupled to said power supply and battery and to said computer and responsive to a failure of said power supply for bypassing said voice/tone switch to provide for said computer to automatically control said tone alarm generator independent of said voice/tone switch to produce said tone alarm sounds at predetermined times during said power supply failure mode of timepiece operation.

2. The talking timepiece of claim 1 in which said tone alarm generator is separate from said speech processing circuitry.

3. The talking timepiece of claim 1 in which a latch means is electrically connected to said computer and to said speech processor for providing for synchronization of operation of said speech processor with said computer during said first mode.

* * * * *